United States Patent [19]

Blum

[11] Patent Number: 4,644,630

[45] Date of Patent: Feb. 24, 1987

[54] METHOD OF PRODUCING A PLASTIC BASEBALL BAT OR THE LIKE HAVING METALLIC APPEARANCE

[75] Inventor: Seymour Blum, Rockville Centre, N.Y.

[73] Assignee: H-G Toys Inc., Long Beach, N.Y.

[21] Appl. No.: 668,548

[22] Filed: Nov. 5, 1984

[51] Int. Cl.[4] ..... A63B 59/06; B23P 19/02; B29C 49/06; B29C 61/02

[52] U.S. Cl. ..... 29/453; 29/458; 156/86; 264/132; 264/134; 264/230; 264/516; 273/72 R

[58] Field of Search ..... 264/512, 515, 516, 132, 264/134, 230; 273/26 B, 67 R, 72 R; 40/19, 628; 156/86; 29/453, 458

[56] References Cited

U.S. PATENT DOCUMENTS

| | | | |
|---|---|---|---|
| Re. 30,805 | 11/1981 | Rhoads | 428/35 |
| 3,110,554 | 11/1963 | Yazumi | 264/132 X |
| 3,120,387 | 2/1964 | Weinstein | 273/72 R |
| 3,214,168 | 10/1965 | Sauber | 273/67 R |
| 3,829,348 | 8/1974 | Spiegel et al. | 156/86 X |
| 4,006,900 | 2/1977 | Divito | 273/26 B |
| 4,143,453 | 3/1979 | Taluba | 29/453 |
| 4,172,873 | 10/1979 | Spicer | 264/230 |

FOREIGN PATENT DOCUMENTS

| | | | |
|---|---|---|---|
| 56-135022 | 10/1981 | Japan | 156/86 |
| 2018138 | 10/1979 | United Kingdom . | |

OTHER PUBLICATIONS

Sample Heat Shrink Sleeve, "The L & R Bath".

*Primary Examiner*—Jan Silbaugh
*Assistant Examiner*—Karen D. Kutach
*Attorney, Agent, or Firm*—Seidel, Gonda, Goldhammer & Abbott

[57] ABSTRACT

A hollow plastic baseball bat or the like has a preprinted plastic sleeve shrink fitted onto a portion of the bat to provide the bat with a metallic appearance.

6 Claims, 6 Drawing Figures

FIG. 1
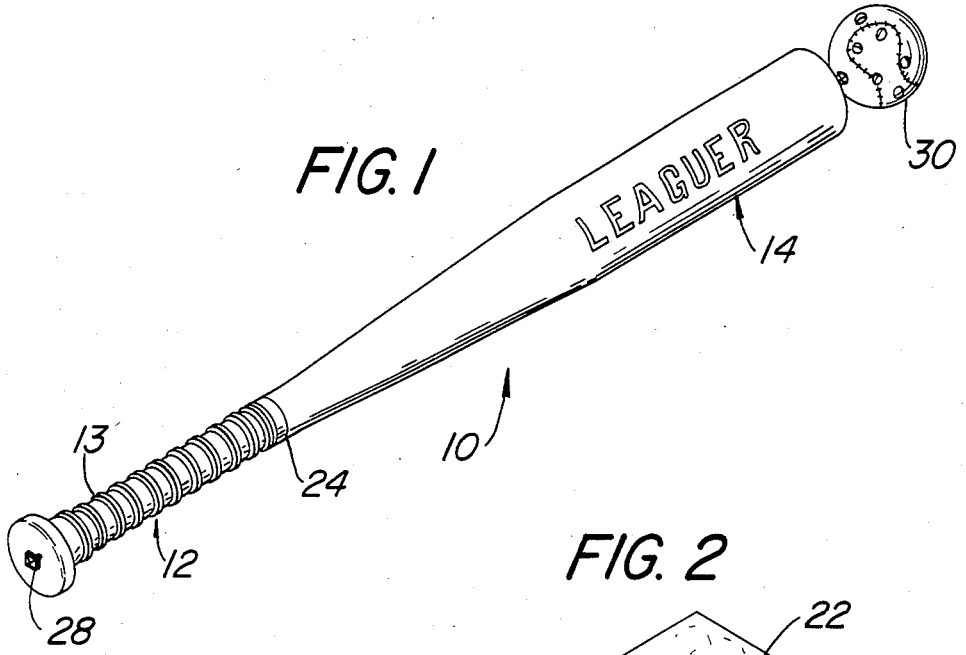
FIG. 2
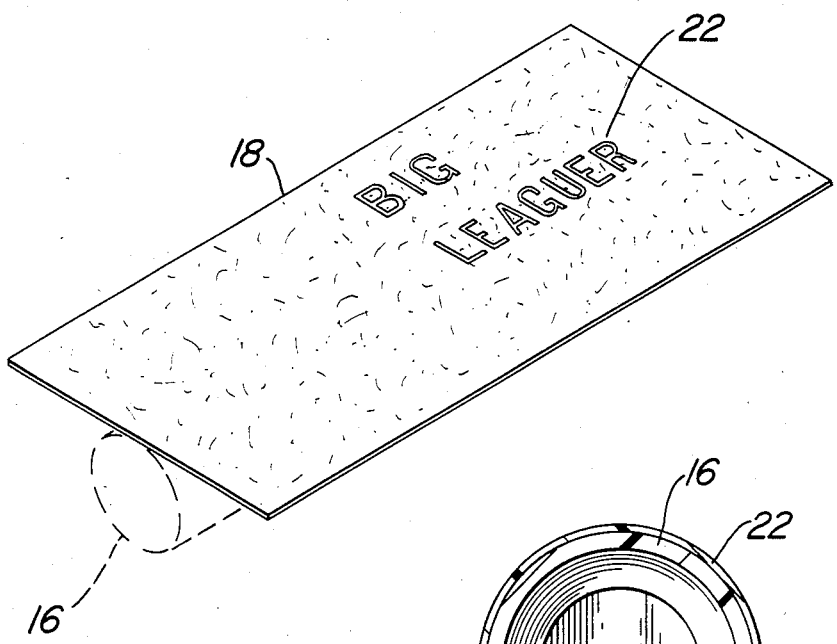
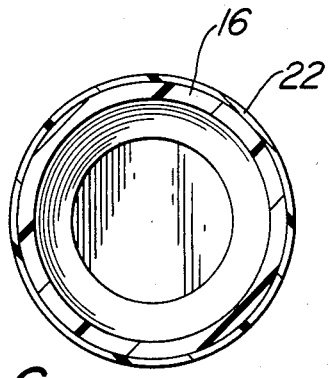
FIG. 6

26
30
28

LEAGUER
22
16
28
14
12
28

32
30
28
5
5
26
14
16
6
6
24
13
12
28

METHOD OF PRODUCING A PLASTIC BASEBALL BAT OR THE LIKE HAVING METALLIC APPEARANCE

This application is related to divisional patent application Ser. No. 802,886 filed on Nov. 29, 1985.

BACKGROUND OF THE INVENTION

Baseball bats which are made from solid wood, hollow metal, hollow plastic, etc, are known. The present invention is directed to solving the problem of how to inexpensively provide a hollow plastic bat, or other implement which is used to strike a ball or other object, with a metallic appearance in a manner which is simple and reproducible.

SUMMARY OF THE INVENTION

The present invention is directed to a hollow plastic baseball bat, or other implement used to strike a ball or other object. Such a bat has a handle portion at one end and a fat portion at the other end thereof. Other implements have a similar striking portion or a shaft. A plastic sleeve is shrink fitted onto the fat portion, striking portion or shaft. The sleeve is preprinted with indicia and colored to have a metallic appearance.

It is an object of the present invention to provide a plastic baseball bat or other implement with a metallic appearance in a manner which is simple, inexpensive, and reproducible.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a baseball bat with a ball attached thereto in accordance with the present invention.

FIG. 2 is a perspective view of a sheet of heat shrinkable material which has been preprinted.

FIG. 6 is a sectional view taken along the line 6—6 in FIG. 4.

DETAILED DESCRIPTION

Figures 3, 4, 5:
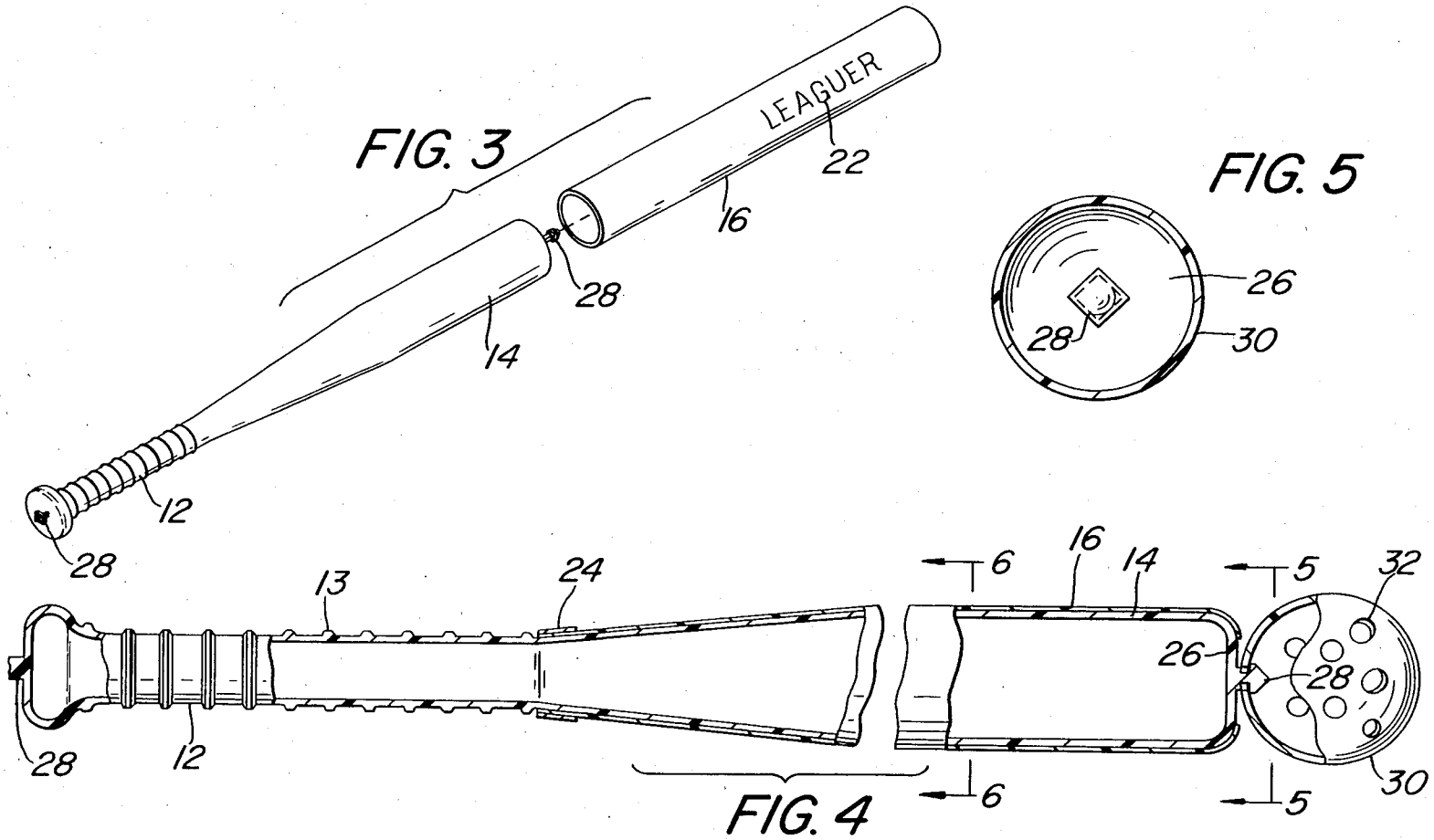
FIG. 3 is an exploded view of the bat and the sheet of FIG. 2 which has been formed into a tube.
FIG. 4 is a longitudinal sectional view of the bat and the attached ball.
FIG. 5 is a sectional view taken along the line 5—5 in FIG. 4.

Referring to the drawings in detail, wherein like numerals indicate like elements, there is shown in FIG. 1 a baseball bat in accordance with the present invention designated generally as 10. The bat 10 is blow molded from a plastic material so as to have a handle portion 12 at one end and a fat portion 14 at the other end. The plastic material is preferably colored black but may be any color such as brown or tan. The handle portion 12 may be provided with integral ribs 13 to improve the gripping thereof. The preferred length for the bat 10 is 29 inches (72.6 cm) but may be any desired length.

The bat 10 as molded is plain and unornamented. A flat sheet 18 of a heat shrinkable clear plastic material is precut to the desired length and width. The length of sheet 18 is substantially greater than its width. Thereafter, the sheet 18 is printed in selected areas with ink while it is flat. The printing applied to the sheet 18 includes indicia 22 such as trademarks, model numbers, name of manufacturer, etc. Thereafter, printing of the sheet 18 preferably includes applying three color printing, namely a first coating of a tint color which is translucent or transparent, followed by a second coating which is opaque and has a metallic appearance. Then, a third coating is applied over the entire second coating in a contrasting opaque color such as white. The first, second and third coatings are applied to the entire surface of sheet 18. The third coating isolates the second coating from direct contact with the plastic bat. The metallic coating is preferably silver, gold or blue and has the appearance of anodized aluminum having iridescent properties but is not limited to those colors.

The sheet 18 is then formed into the sleeve 16 by welding the longitudinal side edges. Sleeve 16 is preferably shaped so that the printing thereon is on the inner surface thereof. Sleeve 16 is then telescoped over the fat portion 14 and the bat 10 and is then placed in a heat tunnel which shrinks the sleeve 16 tightly around the fat portion of the bat. A tape 24 having a metallic appearance may be applied to conceal the ends of sleeve 16 adjacent the handle portion 12 and at the fat portion 14.

The end wall 26 on the fat portion 14 of the bat 10 and/or the end wall at the small end of the bat has an integral projection 28 extending along the longitudinal axis of the bat. See FIGS. 4 and 5. A hollow plastic ball 30 is provided. Ball 30 has a plurality of openings 32. One of the openings 32 corresponds to the size and shape of the projections 28. Projections 28 are of a size so that they may extend through said one opening 32 whereby the ball 30 is attached to the bat 10 with a snap fit. The structure described above enables the ball 30 to be releasably attached to the bat 10 for purposes of merchandising, for purposes of storage, etc.

In view of the above, it wil be noted that the metallic appearance of the bat 10 results from the coating supplied to the sheet 18 before it is formed into the sleeve 16. Since the indicia 22 is printed while the sheet 18 is flat, it may be printed faster with better registration using conventional equipment as compared with applying the indicia to the rounded surface of the bat by specialized equipment. Since sheet 18 is clear, both the indicia and second coating are visible while the second coating is tinted by the first coating.

The present invention may be embodied in other specific forms without departing from the spirit or essential attributes thereof and, accordingly, reference should be made to the appended claims, rather than to the foregoing specification, as indicating the scope of the invention.

I claim:

1. A method of producing a metallic appearance on a non-metallic article comprising the steps of: moulding an elongated generally conical shaped plastic bat having a fat end, a handle end and a tapered portion between the handle and fat end; providing a flat substantially transparent heat-shrinkable film; applying an opaque coating having a metallic appearance on substantially all of one surface of the flat clear film; folding the coated film to form a tube having a continuous outer surface which is the non-coated surface and having a diameter sufficient to permit telescoping of the tube over the fat end of the bat; cutting the film to a length substantially equal to the length of the tapered portion and fat end of the non-metallic bat; telescoping the tube over the tapered portion of the fat end of the bat; and applying heat to shrink the film onto the surface of the bat so as to provide an illusion of a metallic structure for the surface of the bat covered by the film.

2. A method as claimed in claim 1 further comprising the step of applying a contrasting substantially opaque coating to the metallic coating prior to folding the coated film.

3. A method as claimed in claim 1 further comprising the step of printing indicia on a localized region of said surface of the flat clear film prior to applying said opaque coating having a metallic appearance to that surface.

4. A method is claimed in claim 1 further comprising the steps of applying a transparent tint coating to the surface of the film prior to applying the opaque coating having a metallic appearance to that surface.

5. A method is claimed in claim 1 further comprising the steps of: moulding an axial extending projection at one end of the bat which projection is adapted to facilitate removable attachment of an object to the bat; and attaching a perforated object onto the projection.

6. A method of providing a metallic appearance on a portion of a non-metallic bat comprising: moulding an elongated plastic bat having a handle end, a central portion and a fat end; providing a substantially transparent heat-shrinkable film; applying a substantially continuous opaque metallic appearance coating on one surface of the film; cutting the film to a length substantially equal to the length of the central portion and the fat end of the bat; forming the film into a tube having a continuous outer non-coated surface; telescoping the tube over the tapered central portion and fat end of the bat; and, applying heat to shrink the film onto the surface of the central portion and the fat end of the bat so as to create an illusion of a metallic structure on that portion of the bat.

* * * * *